US006039043A

United States Patent [19]

Graber et al.

[11] Patent Number: 6,039,043

[45] Date of Patent: Mar. 21, 2000

[54] UNDERWATER AIR SUPPLY SYSTEM

[75] Inventors: John H. Graber, Wind Lake, Wis.; Mitchell P. Pomerantz, Highland Park, Ill.

[73] Assignee: Johnson Worldwide Associates, Inc., Sturtevant, Wis.

[21] Appl. No.: 09/013,953

[22] Filed: Jan. 27, 1998

[51] Int. Cl.[7] ..... A61M 15/00; A62B 7/00

[52] U.S. Cl. ..... 128/202.14; 128/206.28; 128/202.27; 405/186; 441/96

[58] Field of Search ..... 128/200.14, 201.27, 128/201.28, 201.29, 202.14, 202.19, 204.18, 204.26, 205.24, 202.27; 405/186; 441/96, 99

[56] References Cited

U.S. PATENT DOCUMENTS

| | | | |
|---|---|---|---|
| 3,898,705 | 8/1975 | Schuler | 441/96 |
| 4,137,585 | 2/1979 | Wright, III | 441/186 |
| 4,227,521 | 10/1980 | Hart et al. . | |
| 4,681,552 | 7/1987 | Courtney | 441/92 |
| 4,796,618 | 1/1989 | Garraffa . | |
| 4,964,404 | 10/1990 | Stone | 128/204.22 |
| 5,092,325 | 3/1992 | Ainscough | 128/201.27 |
| 5,249,890 | 10/1993 | Bergstrom | 405/186 |
| 5,408,993 | 4/1995 | Gomez et al. | 128/202.14 |
| 5,520,485 | 5/1996 | Hermansen | 405/186 |
| 5,746,543 | 5/1998 | Leonard | 405/186 |
| 5,775,323 | 7/1998 | Knott | 128/202.27 |

FOREIGN PATENT DOCUMENTS 0 278 598 9/1988 European Pat. Off. .

*Primary Examiner*—John G. Weiss
*Assistant Examiner*—Joseph F. Weiss, Jr.
*Attorney, Agent, or Firm*—Foley & Lardner

[57] ABSTRACT

An underwater air supply system for use with an air supply tank and a buoyancy chamber includes a base module and a plurality of interchangeable modules releasably connectable to the base module. Each module includes at least one of an air supply buoyancy chamber inflator for selectively supplying air from the air supply tank to the buoyancy chamber, a buoyancy chamber exhaust for selectively exhausting air from the buoyancy chamber, an oral buoyancy chamber inflator for enabling a diver to orally inflate the buoyancy chamber, and a regulator for supplying air to a diver from the air supply.

18 Claims, 7 Drawing Sheets

FIG. 3
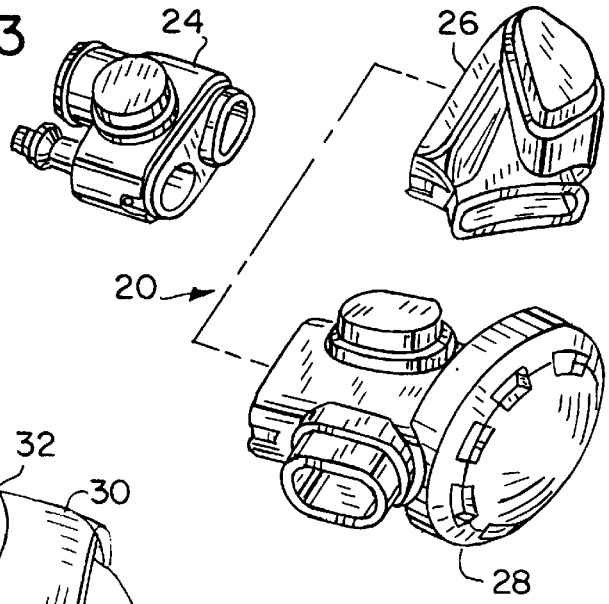
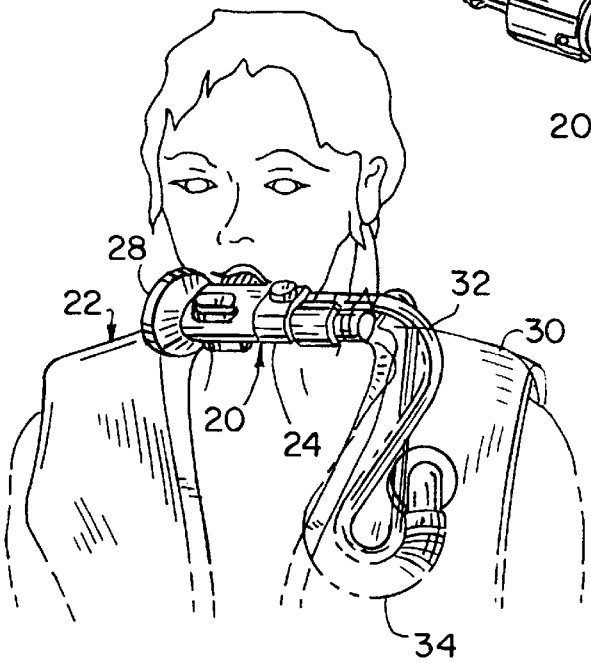
FIG. 2
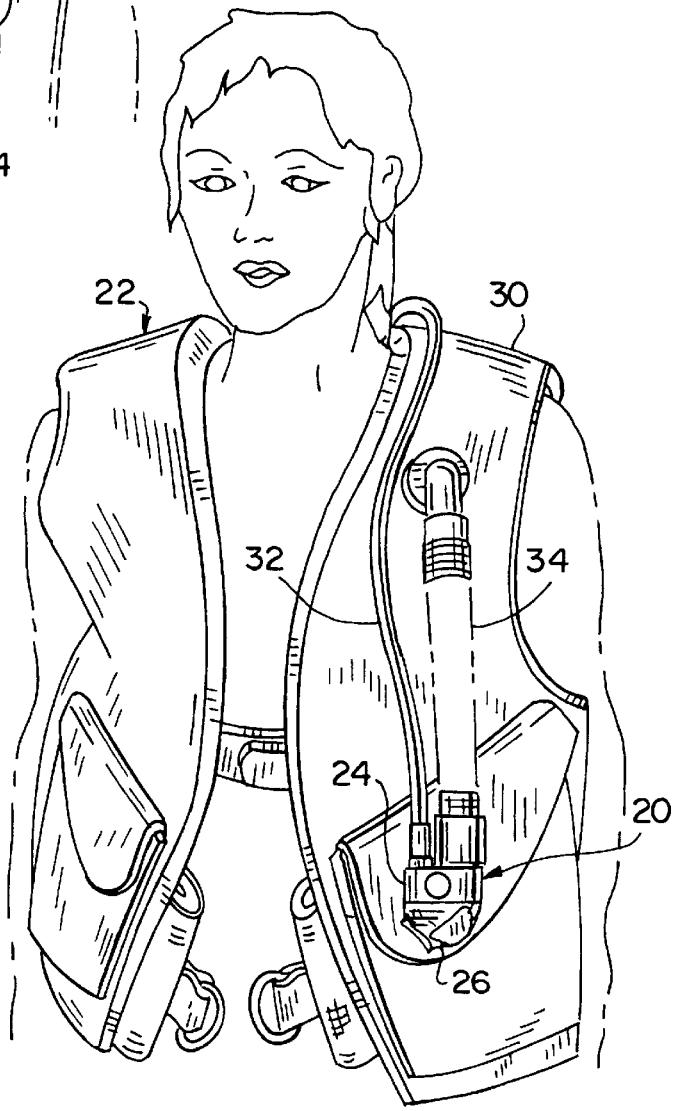
FIG. 1

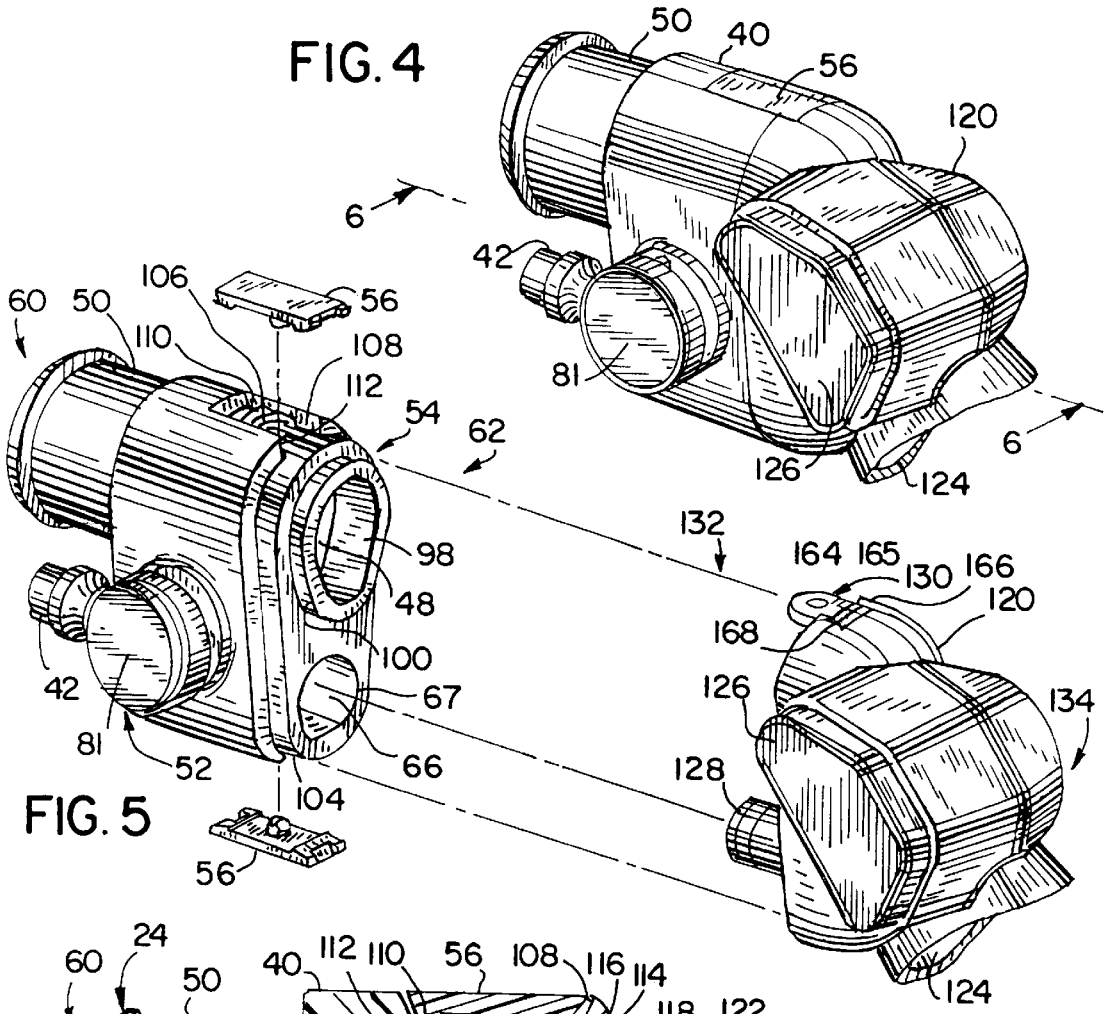
FIG. 4
50
40
56
120
6
42
81
126
124
6
60
50
106
56
110
108
112
54
62
98
48
100
42
67
81
52
66
104
56
FIG. 5
132
164
165
130
166
120
168
126
134
128
124
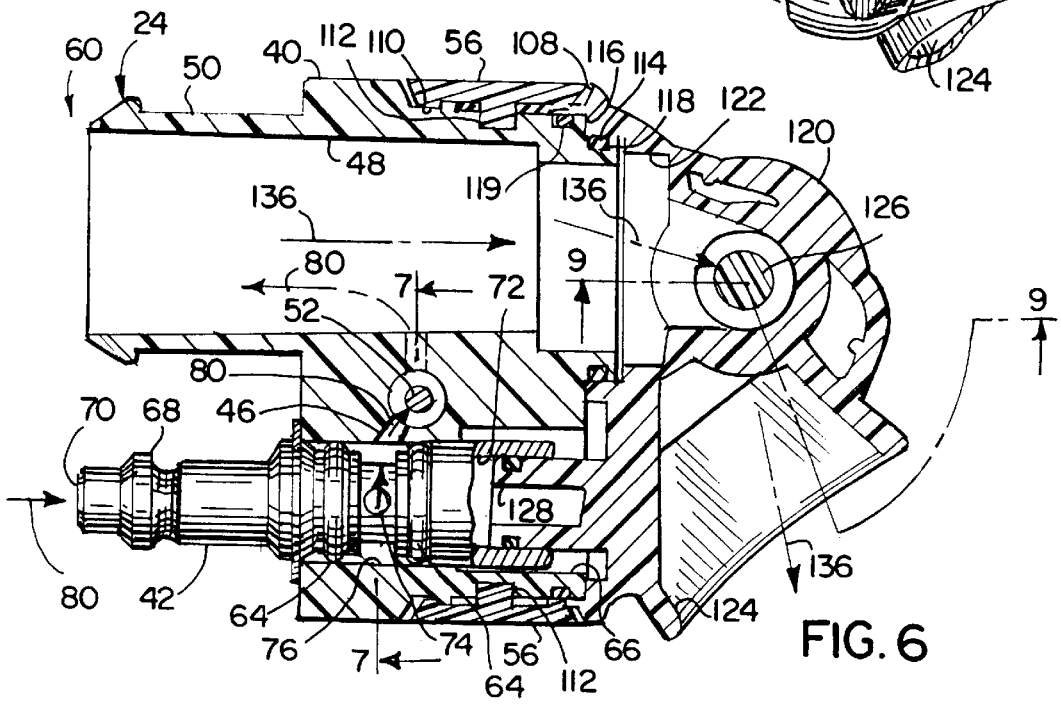
60
24
50
40
112
110
56
108
116
114
118
122
120
48
119
136
126
136
80
9
7
72
52
9
80
70
68
46
128
136
80
42
64
76
7
74
56
64
112
66
124
FIG. 6

FIG. 7
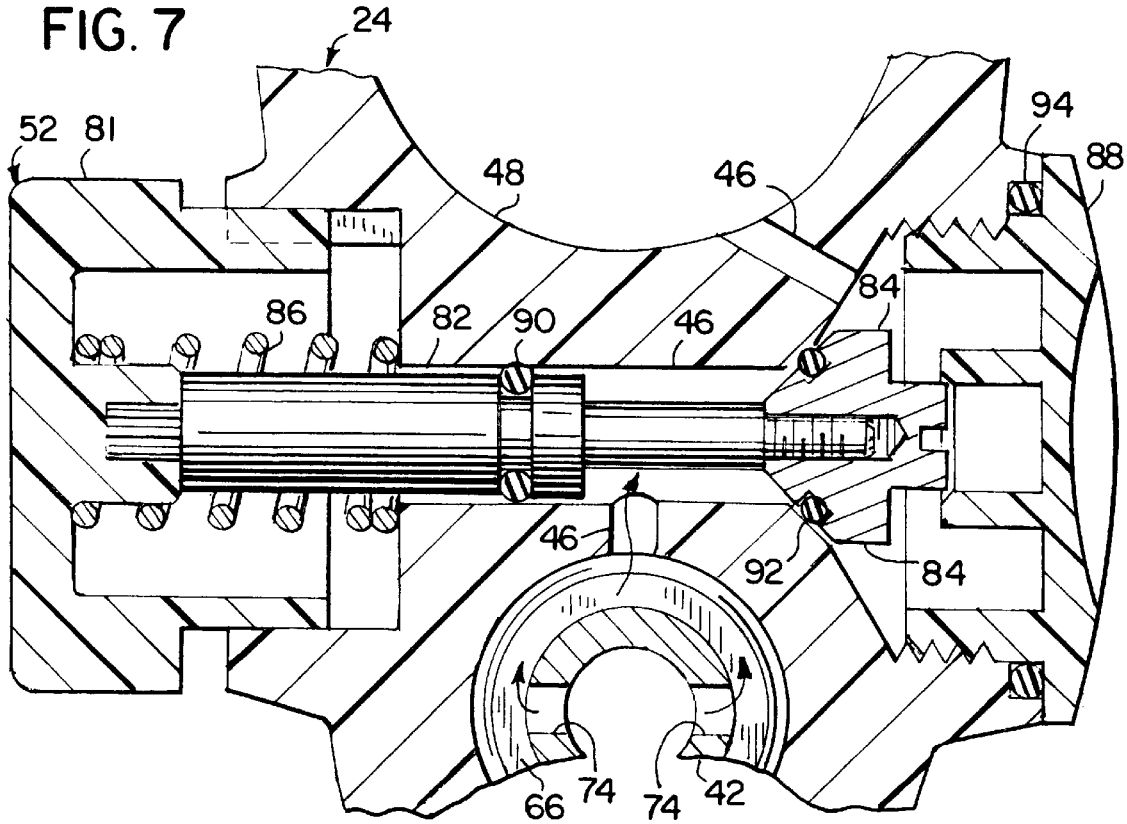
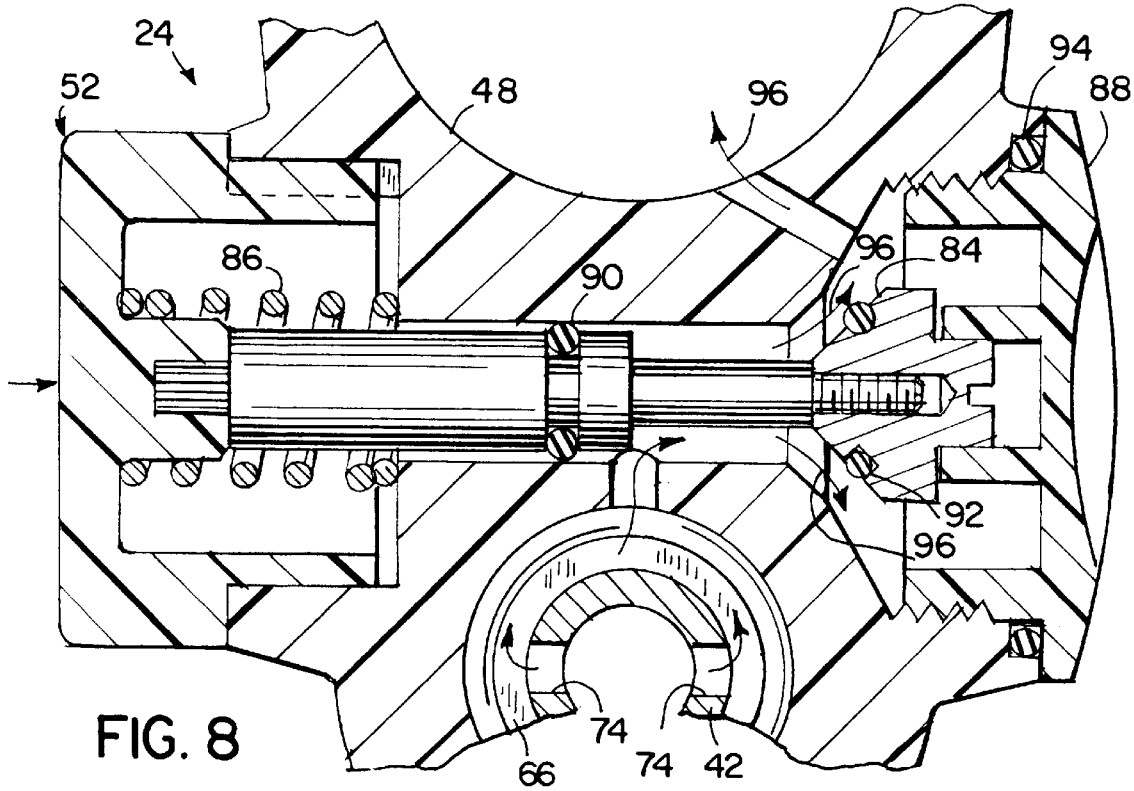
FIG. 8

FIG. 9
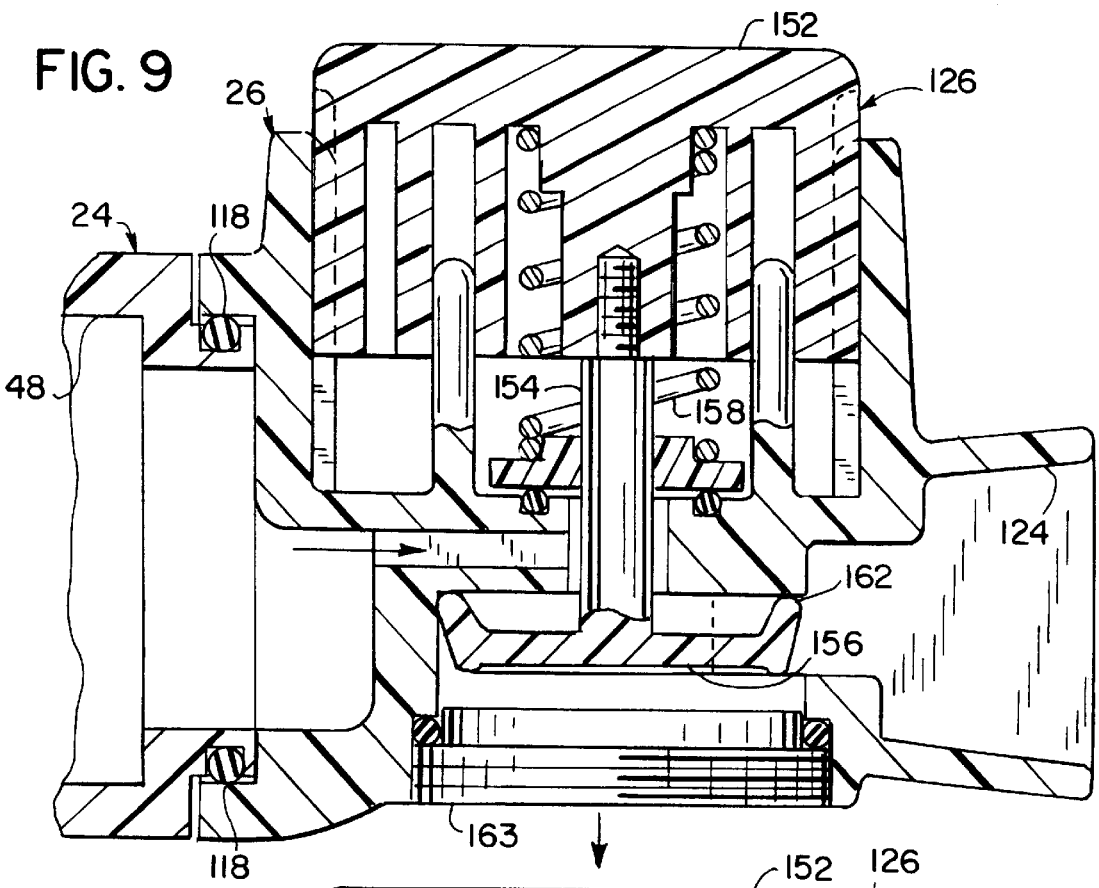
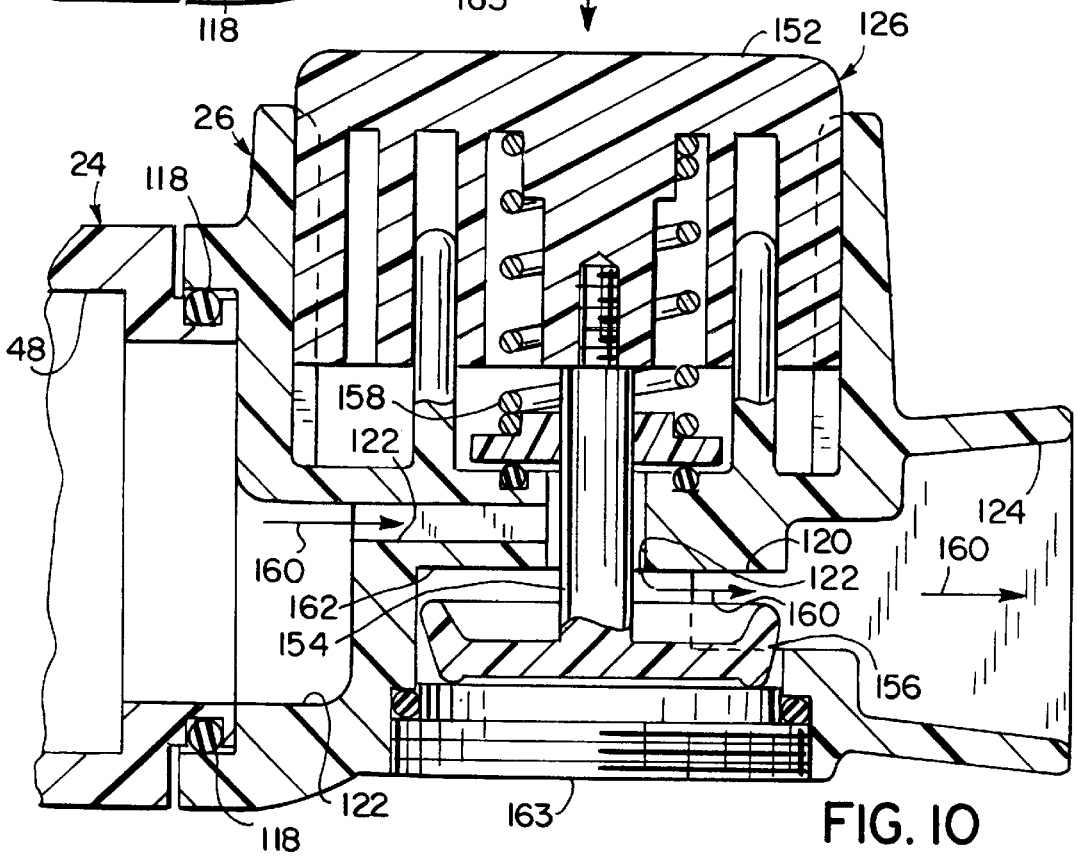
FIG. 10

FIG. 11
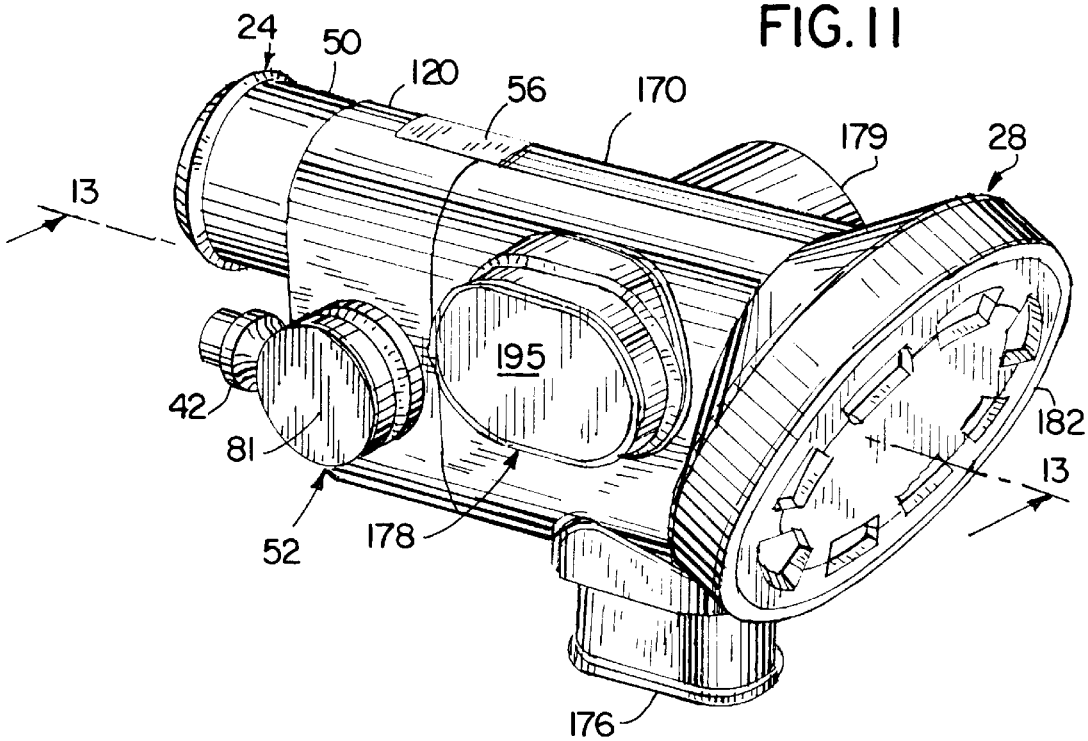
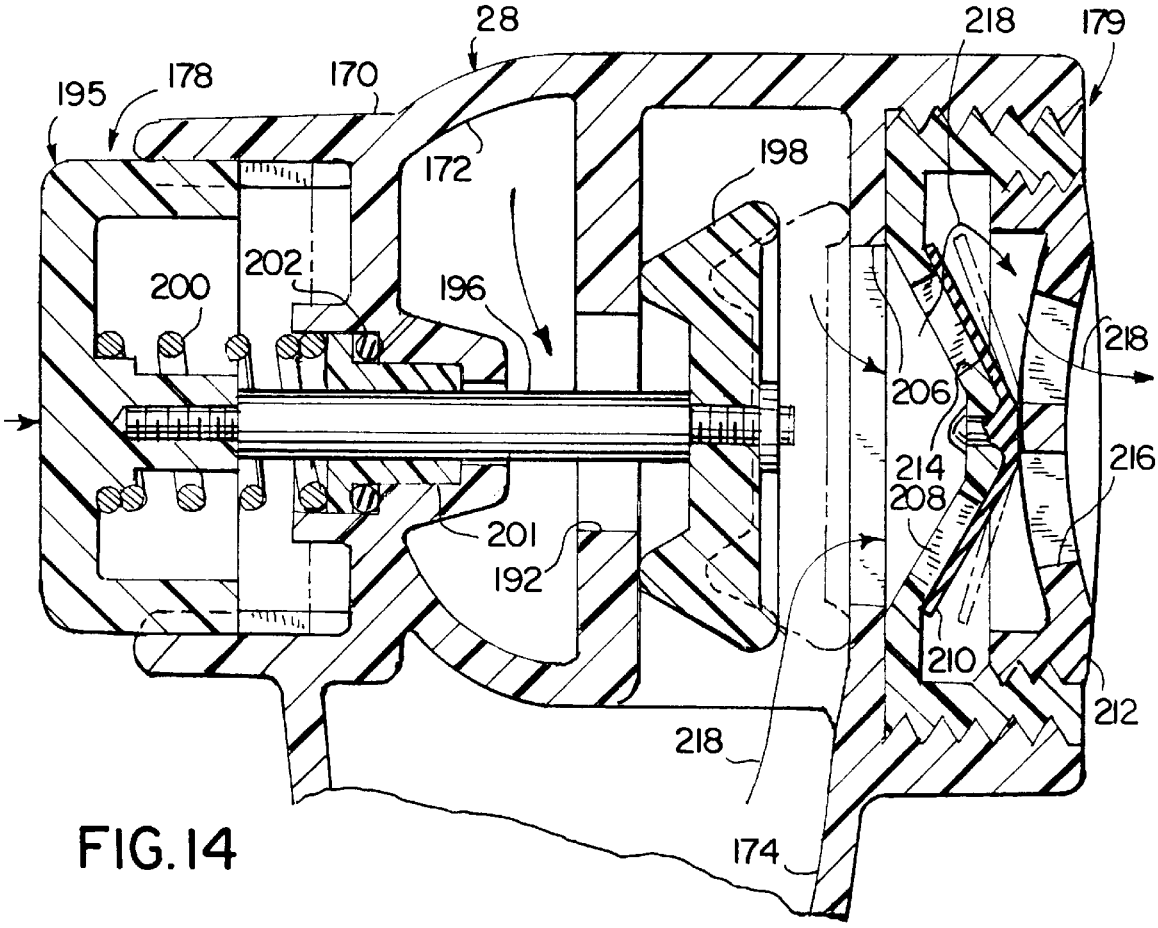
FIG. 14

UNDERWATER AIR SUPPLY SYSTEM

FIELD OF THE INVENTION

The present invention relates to underwater air supply systems for use with an air supply tank and a buoyancy chamber. In particular, the present invention relates to an underwater air supply system having a base module configured for being releasably connected to one of a plurality of add-on modules enabling the capability of the underwater air supply system to be easily upgraded.

BACKGROUND OF THE INVENTION

Underwater diving equipment typically includes an air supply tank, a buoyancy compensator and an air supply system for delivering air from the air supply tank to the diver and the buoyancy compensator. Conventional air supply systems include a first stage regulator, a second stage regulator and a power inflator. As conventionally known, the first stage regulator delivers air to the second stage regulator through a first high-pressure line and delivers air to the power inflator through a second high-pressure line. The second stage regulator delivers air to the diver in response to inhalation by the diver.

The power inflator comprises a valve mechanism that enables the diver to inflate the buoyancy compensator by selectively directing air from the second high-pressure line to the buoyancy compensator via a large diameter flexible hose fitted to the buoyancy compensator. Power inflators frequently additionally include an exhaust valve mechanism and a mouth piece for enabling air to be exhausted from the buoyancy compensator through the large diameter hose and for enabling the diver to orally inflate the buoyancy compensator through the mouth piece and through the large diameter hose.

In many diving situations, it is desirable that the air supply system additionally include an auxiliary second stage regulator should the primary second stage regulator of the diver or a companion diver fail or otherwise becomes inoperable. In "octopus" air supply systems, the auxiliary second stage regulator is connected to the first stage regulator by yet a third high-pressure line extending from the first stage regulator. As a result, octopus air supply systems generally include three high-pressure lines extending from the first stage regulator for providing air to the power inflator, the primary second stage regulator and the auxiliary second stage regulator. Consequently, octopus air supply systems are complex, difficult to manufacture and difficult to use and manipulate underwater.

To eliminate one of the high-pressure lines extending from the first stage regulator and thereby simplify the construction and manipulation of the system under water, other air supply systems include a Y-shaped splitter tube having an inlet and two outlets for supplying air from a single high-pressure line to the power inflator connected to one outlet and to the auxiliary second stage regulator connected at the other outlet. Although effective at eliminating one of the high-pressure lines extending from the first stage regulator, these air supply systems still require two separate and independent units, the power inflator and the auxiliary second stage regulator. Consequently, this system is bulky and requires the diver to shift back and forth between the mouth piece of the auxiliary second stage regulator and the power inflator if the diver needs to orally inflate the buoyancy compensator while utilizing the auxiliary second stage regulator. Shifting between mouth pieces requires that water, sand and other particles within the mouth pieces be purged before use and requires valuable time.

To eliminate the need for a third high-pressure line and to also eliminate the need to shift between the mouth pieces of the auxiliary second stage regulator and the power inflator, a third air supply system utilizing an integrated power inflator and regulator has been developed. This integrated inflator-second stage regulator, described in U.S. Pat. No. 4,227,521, and assigned to UnderSea Industries, Inc., a division of Johnson Worldwide Associates, utilizes a single integrated mechanism connected to a single high-pressure line and provides the same functions previously provided by the separate power inflator and the separate auxiliary second stage regulator. Consequently, this air supply system is less complex and more easy to operate under water. However, because this system utilizes a single integrated mechanism for providing the functions of both the power inflator and the auxiliary second stage regulator, both functions must be inherently purchased together in contrast to the two outlet system in which the power inflator and the auxiliary second stage regulator can be purchased separately at different times by the diver to enable the diver to upgrade his or her air supply system according to the diver's individual needs and budget.

As a result, there is a continuing need for an air supply system that requires a minimum number of high-pressure lines extending from the first stage regulator, that eliminates the necessity of shifting between separate mouth pieces of an auxiliary second stage regulator and a power inflator and enables the diver to individually upgrade his or her air supply system based upon the diver's needs and budget.

SUMMARY OF THE INVENTION

The present invention is directed to an underwater air supply system for use with an air supply tank and a buoyancy chamber. The underwater air supply system includes a base module and a plurality of interchangeable modules releasably connectable to the base module. Each module includes at least one of the following: an air supply buoyancy chamber inflator for selectively supplying air from the air supply tank to the buoyancy chamber, a buoyancy chamber exhaust for selectively exhausting air from the buoyancy chamber, an oral buoyancy chamber inflator for enabling a diver to orally inflate the buoyancy chamber, and a regulator for supplying air to a diver from the air supply.

In accordance with one aspect of the present invention, the base module includes a first body having a first air supply conduit adapted to be connected to the air supply tank and a first buoyancy chamber conduit adapted to be connected to the buoyancy chamber, an inflation conduit interconnecting the first air supply conduit and the first buoyancy chamber conduit and a valve selectively moveable to open and close the inflation conduit.

In accordance with yet another aspect of the present invention, one of the plurality of interchangeable modules releasably interconnectable to the base module includes a second body adapted for being releasably interconnected to the first body, wherein the second body includes a second buoyancy chamber conduit adapted to communicate with the first buoyancy chamber conduit when the first and second bodies are connected, a mouth piece connected to the second buoyancy chamber conduit, a plug configured to occlude the first air supply conduit and a valve selectively moveable to open and close the second buoyancy chamber conduit.

In accordance with yet another aspect of the present invention, one of the plurality of interchangeable modules connectable to the base module includes a second body adapted to be releasably connected to the first body, wherein the second body includes a second air supply conduit and a second buoyancy chamber conduit adapted to communicate with the first air supply conduit and the first buoyancy chamber conduit, respectively, when the first and second bodies are connected, a breathing chamber connected to the second air supply conduit and the second buoyancy chamber conduit, a mouth piece connected to the breathing chamber, a demand valve between the breathing chamber and the second air supply conduit and a valve between the breathing chamber and the second buoyancy chamber conduit. The demand valve opens in response to a pressure drop within the breathing chamber.

BRIEF DESCRIPTION OF THE DRAWINGS

FIG. 1 is a perspective view of a diver wearing an underwater diving system including the modular air supply system having a base module and a first add-on module.

FIG. 2 is a perspective view of a diver wearing an underwater diving system including the modular air supply system having a base module and a second add-on module.

FIG. 3 is a perspective view illustrating the base module, the first add-on module and the second add-on module.

FIG. 4 is a perspective view illustrating the first add-on module releasibly connected to the base module.

FIG. 5 is a perspective view illustrating the first add-on module disconnected from the base module.

FIG. 6 is a sectional view of the base module and the first add-on module of FIG. 4 taken along line 6—6.

FIG. 7 is a sectional view of the base module of FIG. 6 taken along lines 7—7 illustrating a valve mechanism in a closed state.

FIG. 8 is a sectional view of the base module of FIG. 6 taken along lines 8—8 illustrating a valve mechanism in an opened state.

FIG. 9 is a sectional view of the first add-on module of FIG. 6 taken along lines 9—9 illustrating a valve mechanism of the first add-on module in a closed state.

FIG. 10 is a sectional view of the first add-on module of FIG. 6 taken along lines 10—10 illustrating a valve mechanism of the first add-on module in an open state.

FIG. 11 is a perspective view of the base module releasibly connected to the second add-on module.

FIG. 14 is a sectional view of the second add-on module of FIG. 13 taken along lines 14—14 illustrating first and second valve mechanisms of the second add-on module.

DETAILED DESCRIPTION OF THE PREFERRED EMBODIMENTS

I. OVERVIEW

Figures 12, 15:
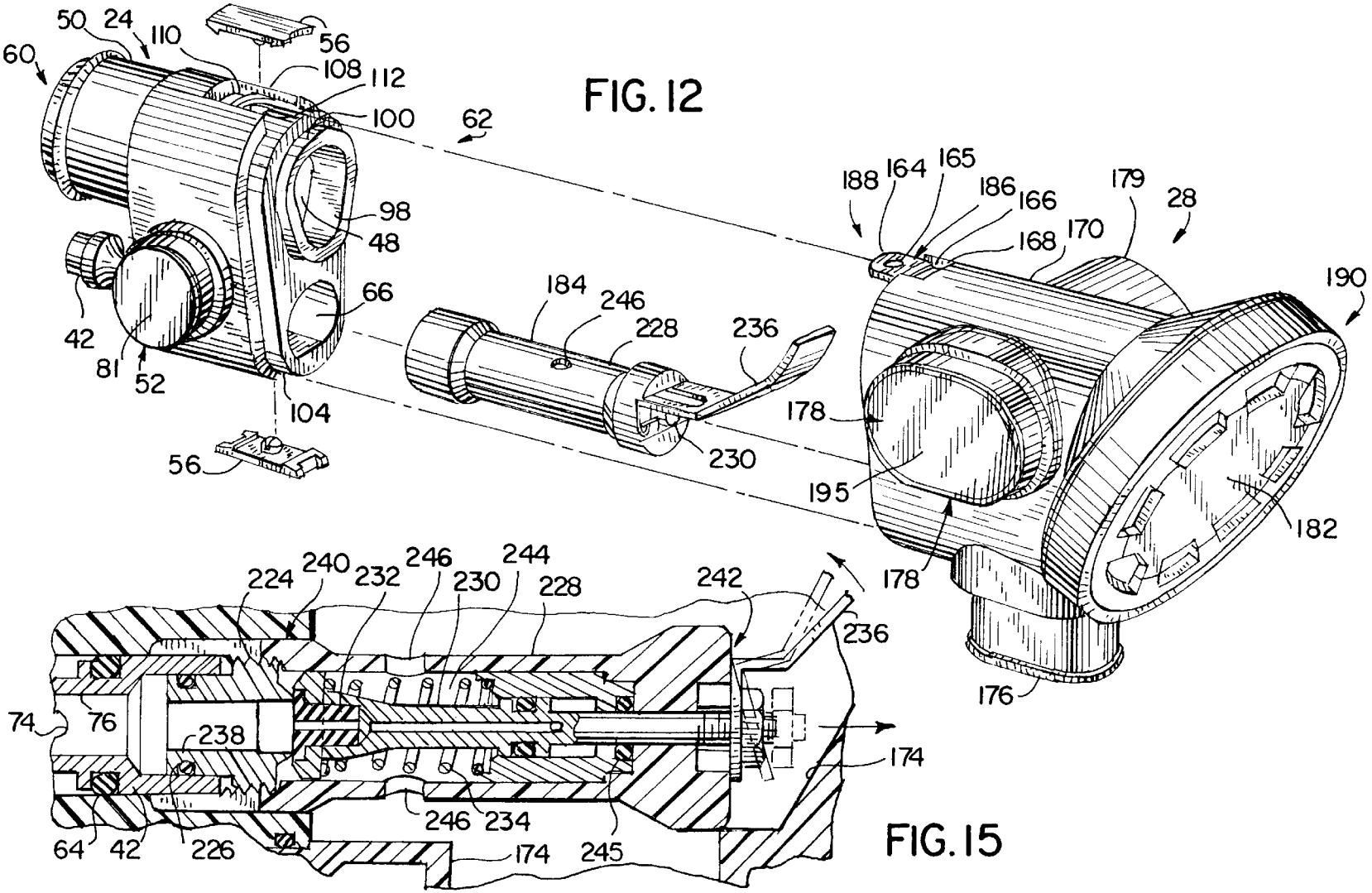
FIG. 12 is a perspective view illustrating the second add-on module disconnected from the base module and partially exploded.
FIG. 15 is a fragmentary sectional view of the base module and the second add-on module of FIG. 13 illustrating a third valve mechanism of the second add-on module.

FIGS. 1–3 illustrate a modular air supply system 20 embodying the present invention. FIG. 1 is a perspective view of a diver wearing an underwater diving system 22 including modular air supply system 20 comprising a base module 24 and a first add-on module 26. FIG. 2 illustrates the diver wearing underwater diving system 22 including air supply system 20 comprising base module 24 and a second add-on module 28. FIG. 3 illustrates modules 24, 26 and 28 in greater detail. As shown by FIG. 1, underwater diving system 22 includes an air supply tank and a first stage regulator (not shown), a buoyancy compensator 30, high-pressure line 32, buoyancy compensator inflator hose 34 and air supply system 20. The air supply tank (not shown) is conventionally known and supplies pressurized air through a conventionally known first stage regulator (not shown) in a conventionally known manner as illustrated and described in Hart et al. U.S. Pat. No. 4,227,521 (hereby incorporated by reference). The pressurized air from the first stage regulator is delivered through flexible high-pressure line 32 to air supply system 20. Air supply system 20 selectively delivers the pressurized air to buoyancy compensator 30 through hose 34 or to the diver.

Buoyancy compensator 30 defines an internal buoyancy chamber configured to inflate upon receiving pressurized air so as to provide the diver with a neutral or slightly positive or negative buoyancy to assist the diver in underwater maneuvers. Buoyancy compensator 30 preferably comprises a conventionally known buoyancy jacket or vest worn by the diver. Alternatively, buoyancy compensator 30 may comprise any one of a variety of other inflatable buoyancy compensation devices.

As shown by FIG. 3, air supply system 20 is modular and includes base module 24 and add-on modules 26 and 28. Add-on modules 26 and 28 are interchangeable modules that may be releasably connected to base module 24. Each module 24, 26 and 28 includes at least one of the following components or mechanisms: (1) an inflator for selectively supplying air from the air supply tank to 10 the buoyancy compensator, (2) a buoyancy compensator exhaust for selectively exhausting air from the buoyancy compensator, (3) an oral buoyancy compensator inflator for enabling the diver to orally inflate the buoyancy compensator, and (4) a second stage regulator for supplying air to the diver from the air supply tank. In the exemplary embodiment illustrated, base module 24 includes an inflator for selectively directing air from the air supply tank and from the high-pressure line 32 to buoyancy compensator 30 via hose 34 to enable the diver to selectively inflate buoyancy compensator 30. Module 26 includes a buoyancy compensator exhaust for selectively exhausting air from the buoyancy compensator 30 and an oral buoyancy compensator inflator for enabling the diver the orally inflate the buoyancy compensator 30. As shown by FIG. 1, module 26 is releasably connected to module 24 to provide the diver all of these functions in a single, compact unit requiring a single high-pressure line 32 extending from the first stage regulator.

Module 28 is similar to module 26 but additionally includes a second stage regulator for supplying air to the diver from the air supply tank and from high-pressure line 32. Thus, module 26 includes a buoyancy compensator exhaust for selectively exhausting air from the buoyancy compensator, an oral buoyancy compensator inflator for enabling the diver to orally inflate the buoyancy compensator and a second stage regulator for supplying air to the diver from the air supply tank through high-pressure line 32. Each of these functions is provided in a single compact unit utilizing a single high-pressure line 32. In addition to eliminating the need for a separate high-pressure line for the auxiliary second stage regulator provided by module 28, module also enables the diver to utilize the second stage regulator and to alternatively orally inflate buoyancy compensator 30 without switching between separate mouth pieces. Because module 28 is releasably connected to base module 24 and is interchangeable with module 26, air supply system 20 enables the diver to selectively upgrade his or her system by first purchasing module 26 which includes fewer functions and which is generally less complex and less expensive. Air supply system 20 also enables the diver to selectively upgrade his or her system by later purchasing module 28 which can be interchanged with module 26 and which provides the same functions of module 26 but additionally provides an auxiliary second stage regulator.

II. BASE MODULE

FIGS. 4–6 illustrate base module 24 and add-on module 26 in greater detail. In particular, FIG. 4 illustrates module 26 releasably connected to base module 24. FIG. 5 illustrates module 26 disconnected from base module 24. FIG. 6 is a cross-sectional view illustrating module 26 and base module 24 connected to one another. As best shown by FIGS. 5 and 6, base module 24 generally includes body 40, high-pressure line air barrel 42, inflation conduit 46, buoyancy compensator conduit 48, hose coupling 50, valve assembly 52, module interface 54 and fasteners 56. Body 40 comprises a generally rigid housing or casing having a first end 60 and a second opposite end 62. Body 40 has an interior partitioned to define or support high-pressure line air barrel 42, air supply conduit 44, inflation conduit 46, buoyancy compensator conduit 48, hose coupling 50, valve assembly 52 and module interface 54. Body 40 initially includes a bore 66 which extends through body 40 from end 60 to end 62 where bore 66 terminates at port 67. Body 40 is preferably integrally formed as part of a single unitary body from a material unaffected by corrosion, such as fiberglass reinforced plastic. Body 40 is also configured for being releasably retained and connected to add-on modules 26 and 28 by fasteners 56. Alternatively, body 40 may be formed from a plurality of subhousings interconnected to one another.

Air barrel 42 is an elongate, metallic barrel carrying seals 64 to be fitted within bore 66 of body 40. Air barrel 42 includes high-pressure line coupling portion 68, axial inlet 70, axial outlet 72 and radial outlet 74. High-pressure line coupling portion 68 of air barrel 42 projects from end 60 of body 40 and is configured for coupling base module 24 to high-pressure line 32 (shown in FIGS. 1 and 2) such that air supplied through high-pressure line 32 flows into air barrel 42 through axial inlet 70. Seals 64 preferably comprise O-rings positioned on opposite sides of radial outlet 74 and are sealed against body 40 on opposite sides of inflation conduit 46. As a result, air barrel 42 provides an air supply passage or conduit 76 which extends from axial inlet 70 through air barrel 42 and through radial outlet 74 into bore 66 to communicate with inflation conduit 46. Air supply conduit 76 further extends from axial inlet 70 to axial outlet 72 adjacent interface 54 for supplying air to module 28 as later described herein. As discussed above, air barrel 42 press fit within bore 66 of body 40, provides a coupling for connecting base module 24 to high-pressure line 32 (as shown in FIGS. 1 and 2) and also defines air supply conduit 76. Alternatively, the high-pressure line coupling provided by air barrel 42 may be provided by one of a variety of other coupling mechanisms which may be mounted to body 40 or integrally formed as part of body 40. In addition, air barrel 42, air supply conduit 76 may alternatively be completely defined by bore 66 itself or a similar bore extending within body 40.

Inflation conduit 46 extends through body 40 between air supply conduit 76 and buoyancy compensator conduit 48. As shown by FIG. 6, inflation conduit 46 communicates with bore 66 between seals 64. Inflation conduit 46 directs air from air supply conduit 76 into buoyancy compensator conduit 48.

Buoyancy compensator conduit 48 is an elongate air passage within body 40, terminating at port 98 and further extending through hose coupling 50. Hose coupling 50 extends from body 40 and is configured for connecting module 24 to buoyancy compensator hose 34 (shown in FIGS. 1 and 2). As a result, air from high-pressure line 32 flows through air supply conduit 76, across inflation conduit 46 and through buoyancy compensator 48 into buoyancy compensator hose 32 to inflate buoyancy compensator 30. The inflation of buoyancy compensator 30 is controlled by the actuation of valve assembly 52. Although coupling 50 is illustrated as being integrally formed with body 40, coupling 50 may alternatively comprise a separate component sealed and connected to body 40.

Valve assembly 52 is coupled to body 40 within inflation conduit 46. Valve assembly 52 selectively opens and closes inflation conduit 46. In an opened position, valve assembly 52 enables air under high-pressure to flow from air supply conduit 76 through inflation conduit 46 into buoyancy compensator conduit 48 and into buoyancy compensator 30 as indicated by arrows 80.

FIGS. 7 and 8 illustrate valve assembly 52 in greater detail. As shown by FIGS. 7 and 8, valve assembly 52 generally includes inflator button 81, stem 82, seat 84, spring 86, cover 88 and O-rings 90, 92 and 94. As shown by FIGS. 7 and 8, inflator button 81, stem 82 and seat 84 are slidably disposed within body 40 between a closed position (shown in FIG. 7) and an open position (shown in FIG. 8). Cover 88 and O-rings 90 and 94 seal inflation conduit 46 about stem 82 and within body 40. As shown by FIG. 7, spring 86 biases inflator button 81, stem 82 and seat 84 towards the closed position. In this closed position, spring 86 maintains tension on seat 84 preventing air flow from reaching buoyancy compensator conduit 48. As shown by FIG. 8, when inflator button 81 is depressed, air flows around seat 84 through inflation conduit 46 into buoyancy compensator conduit 48 as indicated by arrows 96. As can be appreciated, valve assembly 52 may alternatively comprise any one of a variety of alternative wellknown valve devices.

Module interface 54 is configured for mating with add-on modules 26 and 28. As best shown by FIGS. 5 and 6, module interface 54 is integrally formed as part of body 40 and includes neck 100, neck 104, tab receiving recesses 106, channels 108, detents 110, bores 112, grooves 114, 116 and seals 118, 119. Necks 100 and 104 are formed along an axial face of body 40 at end 62. Neck 100 forms a generally annular collar surrounding port 98 of buoyancy compensator conduit 48. Neck 100 includes groove 114 along its outer circumferential surface for receiving seal 118. Neck 104 extends about both ports 98 and 67 and includes groove 116 sized for receiving seal 119. As shown by FIG. 6, necks 100 and 104 nest within module 26 to releasably connect base module 24 and module 26. The partial nesting of base module 24 within module 26 forms a reliable annular seal about ports 98 and 67.

Channels 108, each of tab receiving recesses 106, channels 108, detents 110, bores 112 are formed on opposite tangential sides of body 40 and are configured for cooperating with fasteners 56 to securely retain base module 24 to either of add-on modules 26 and 28. Tab receiving recesses 106 extend into body 40 and are sized and configured to receive corresponding tabs projecting from modules 26 and 28. Channels 108 extend into body 40 above recesses 106 and are configured for receiving fasteners 56, such that fasteners 56 lie flush with the outer surfaces of modules 24 and either of modules 26 or 28. As described in greater detail with respect to FIGS. 16 and 17, detents 110 and bores 112 cooperate with fasteners 56 to releasably lock module 24 to either modules 26 or 28.

III. FIRST ADD-ON MODULE

FIGS. 4–6 further illustrate add-on module 26. Add-on module 26 generally includes body 120, buoyancy compensator conduit 122, mouth piece 124, valve assembly 126, plug 128 and module interface 130. As best shown by FIG. 5, body 120 includes ends 132 and 134 and is preferably formed as a single unitary body configured for being releasably connected to end 62 of base module 24. Alternatively, body 120 may be formed from a plurality of subhousings interconnected to one another. Body 120 is preferably formed from fiberglass reinforced plastic and includes a partially partitioned interior which defines buoyancy compensator conduit 122 and mouth piece 124.

Buoyancy compensator conduit 122 extends through body 120 from end 132 towards end 134. Buoyancy compensator conduit 122 communicates with mouth piece 124 except when being interrupted by valve mechanism 126. Buoyancy compensator conduit 122 is configured so as to communicate with buoyancy compensator conduit 48 of base module 24 when body 120 and body 40 are releasably connected to one another.

Mouth piece 124 comprises a generally elongate conduit extending through body 40 from end 134 towards end 132. Mouth piece 124 communicates with conduit 122 but for when being interrupted by valve mechanism 126. Mouth piece 124 is preferably configured for being received within the diver's mouth or for supporting an attachment configured to be received within the diver's mouth.

Valve mechanism 126 is coupled to body 120 between conduit 122 and mouth piece 124 so as to selectively open and close conduit 122 for exhausting air from buoyancy compensator 30 (shown in FIG. 1) through conduit 48, conduit 122 and mouth piece 124 (as indicated by arrows 136) or for enabling the diver to orally inflate buoyancy compensator through mouth piece 124, conduit 122 and conduit 48.

FIGS. 9 and 10 illustrate valve mechanism 126 in greater detail. As shown by FIGS. 9 and 10, valve mechanism 126 generally includes deflation button 152, stem 154, seal 156, return spring 158. As shown by FIGS. 9 and 10, deflation button 152, stem assembly 154 and seal 156 are slidably disposed within body 120 between conduit 122 and mouth piece 124. Deflation button 152 and stem 154 carry seal 156 for movement between a closed position adjacent surface 162 (shown in FIG. 9) and an open position proximate sealing cover 163 (shown in FIG. 10). Return spring 158 biases seal 156 against body 120 to seal and interrupt fluid communication between conduit 122 and mouth piece 124. As shown by FIG. 10, depression of deflation button 152 and stem 154 against spring 158 moves seal 156 away from body 120 to provide communication between conduit 122 and mouth piece 124. As a result, air within buoyancy compensator 30 (shown in FIG. 1) can be vented through hose 34, through conduits 48 and 122 and through mouth piece 124 as indicated by arrows 160. Alternatively, depression of deflation button 152 and stem 154 against spring 158 enables the diver to inflate buoyancy compensator 30 (shown in FIG. 1) through mouth piece 124, through conduits 122 and 48 and through hose 34 (shown in FIG. 1).

Referring once again to FIG. 6, plug 128 axially projects from end 132 of module 26 and is configured for blocking or occluding the axial outlet 72 of air barrel 42. Alternatively, plug 128 may be configured for blocking or occluding port 67. Although plug 128 is shown as being integrally formed as part of body 120, plug 128 may alternatively comprise a separate component secured to body 120 or fitted within port 67 to occlude port 67 or the axial outlet 72 of air barrel 42.

Module interface 130 of module 26 releasably connects module 26 to base module 24. As shown by FIGS. 5 and 6, module interface 130 is sized and configured for nestingly receiving necks 100 and 104 of interface 54 of base module 24. Module interface 130 preferably nestingly receives interface 54 of base module 24 so as that the exterior outer surfaces of base module 24 and add-on module 24 are flush with one another.

Module interface 130 of add-on module 26 additionally includes tabs 164 having bores 165, detent 166 and fastener receiving channel 168. Tab 164 projects from end 132 of body 120 and is configured for mating within recess 106 of base module 24. Bore 165 extends through tab 164 and is located so as to align with bore 112 of base module 24 when add-on module 26 is connected to base module 24. Once aligned, bores 165 and 112 receive and capture fastener 56. Detent 166 is a depression extending into body 120 that is sized for capturing fastener 56. Channel 168 extends into body 120 above detent 166 and is sized for receiving fastener 56 so that fastener 56 lies flush with body 120.

IV. SECOND ADD-ON MODULE

Figure 13:
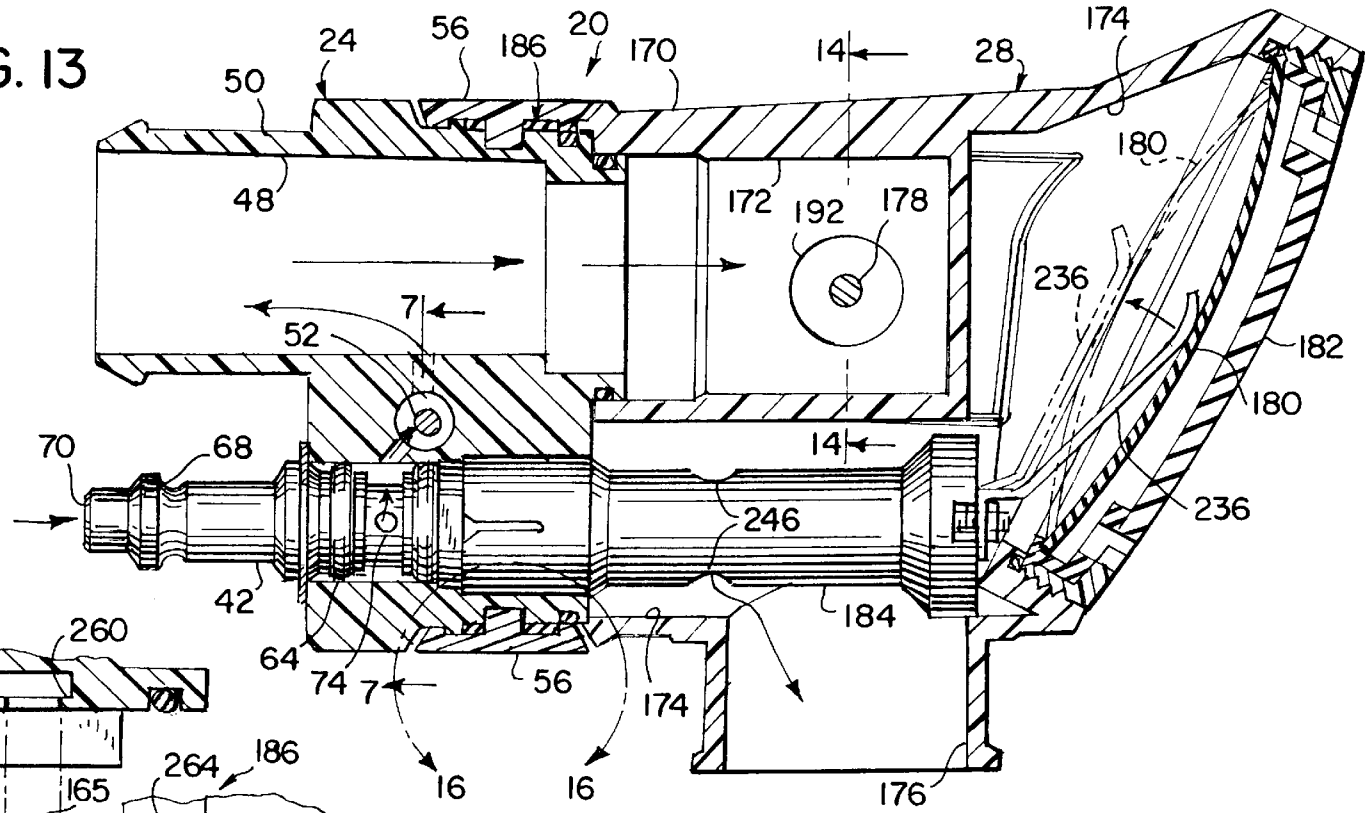
FIG. 13 is a sectional view of the base module and the add-on module of FIG. 11 taken along lines 13—13.

FIGS. 11–13 illustrate base module 24 and add-on module 28 in greater detail. In particular, FIG. 11 is a perspective view illustrating add-on module 28 releasably connected to base module 24. FIG. 12 is a perspective view illustrating add-on module 28 disconnected from base module 24 and partially exploded. FIG. 13 is a cross-sectional view of add-on module 28 and base module 24 connected to one another. As best shown by FIG. 13, add-on module 28 includes body 170, buoyancy compensator conduit 172, breathing or regulator chamber 174, mouth piece 176, valve mechanism 178, valve mechanism 179 (shown in FIG. 14), moveable wall 180, valve assembly 184 and module interface 186. Body 170 preferably comprises an integrally formed casing or housing formed as part of a single unitary body and configured for being releasably connected to base module 24. Alternatively, body 170 may be formed from a plurality of subhousings interconnected to one another. Body 170 is preferably formed from fiberglass reinforced plastic and generally includes a partially partitioned interior forming buoyancy compensator conduit 172, regulator chamber 174 and mouth piece 176. Buoyancy compensator conduit 172 extends from a first axial end 188 of body 170 into body 170 and terminates about an opening 192. Opening 192 connects conduit 172 to regulator chamber 174 and mouth piece 176. Opening 192 is selectively opened and closed by valve mechanism 178.

Regulator chamber 174 extends from the first axially end 188 of body 170 towards a second axial end 190 of body 170. Regulator chamber 174 is configured so as to communicate with axial outlet 72 and air supply conduit 76 when module 28 is removably connected to base module 24. Regulator chamber 174 further communicates with mouth piece 176. Regulator chamber 174 contains valve assembly 184 and directs air flowing through valve assembly 184 from air supply conduit 76 of base module 24 to mouth piece 176 for inhalation by the diver through mouth piece 176.

Mouth piece 176 projects away from the center of body 170 and defines a nozzle configured for being received by the diver's mouth or configured for receiving an attachment to be received within the diver's mouth. Mouth piece 176 communicates with regulator chamber 174 and also communicates with buoyancy compensator conduit 172 when valve mechanism 178 is in an opened position.

FIG. 14 illustrates valve mechanism 178 and valve mechanism 179 in greater detail. As shown by FIG. 14, valve mechanism 178 includes deflation button 195, stem 196, seal 198, return spring 200, washer 201 and O-ring seal 202. Deflation button 195, stem 196 and seal 198 are slidably disposed within body 170; for movement between a closed position in which seal 198 closes and seals opening 192 and an open position in which seal 198 is spaced from opening 192 to allow air to flow between buoyancy compensator conduit 172 and regulator chamber 174 as well as mouth piece 176 (shown in FIG. 13). Return spring 200 extends between body 170 and deflation button 195 to bias seal 198 into the closed position over opening 192. As a result, seal 198 normally seals over opening 192 to retain air within buoyancy compensator 30. Depression of deflation button and stem assembly 196 spaces seal 198 from opening 192 to provide communication between buoyancy conduit 172 and mouth piece 176 for enabling buoyancy compensator 30 to be deflated or for alternatively enabling the diver to orally inflate buoyancy compensator 30.

Valve mechanism 179 is a generally one-way valve for enabling exhaled air from the diver to escape from module 28. Valve mechanism 179 generally includes opening 206, exhaust spider 208, exhaust valve 210 and exhaust cover 212. Opening 206 is defined within body 170 and communicates with regulator chamber 174 and extends generally opposite seal 198 of valve mechanism 178. Opening 206 is preferably sized and configured such that full depressment of deflation button and stem assembly 196 positions seal 198 over opening 206 (as shown in phantom) to seal opening 206 allowing buoyancy compensator 30 to be orally inflated.

Exhaust spider 208 is a generally open support web threaded into body 170 across opening 206. Exhaust spider 208 includes a plurality of openings 214. Exhaust spider 208 supports exhaust valve 210 over opening 206.

Exhaust valve 210 comprises a generally flexible imperforate flap secured to spider 208 and extending over openings 214 of spider 208. Exhaust valve 210 is further retained in place by exhaust cover 212 which is threaded into exhaust spider 208 and which further includes openings 216 for air flow. As shown in phantom, exhaust valve 210 flexes outwardly towards exhaust cover 212 in response to a pressure increase within regulator chamber 174 caused by the diver exhaling into regulator chamber 174. As indicated by arrows 218, flexing of exhaust valve 210 away from spider 208 allows air to flow through openings 214 of spider 208 and through openings 216 of cover 212 for discharge from module 28.

As best shown by FIG. 13, moveable wall 180 is supported by body 170 adjacent to regulator chamber 174 so as to partially define regulator chamber 174. Moveable wall 180 extends between regulator chamber 174 and the marine environment surrounding module 28. Moveable wall 180 preferably comprises a flexible and elastic diaphragm as set forth and described in U.S. Pat. No. 4,508,118 (hereby incorporated by reference). Moveable wall 180 moves in response to pressure changes within regulator chamber 74. As shown in phantom, moveable wall 180 moves into regulator chamber 174 upon a pressure drop within regulator chamber 174. This pressure drop is caused by the diver inhaling air within chamber 174. As a result, moveable wall 180 engages valve assembly 184 to cause valve assembly 184 to open and thereby direct air into regulator chamber 174. Moveable wall 180 is secured to body 170 by cover 182.

Valve assembly 184 is illustrated in greater detail in FIG. 15. As shown by FIG. 15, valve assembly 184 includes orifice 224, seal 226, housing 228, poppet 230, seat 232, spring 234 and lever 236. Orifice 224 carries seal 226 and is configured for fitting within axial outlet 72 of air barrel 42 within base module 24 when module 24 and module 28 are connected to one another. Orifice 224 includes central passage 238 which further communicates with air supply conduit 76 within air barrel 42.

Housing 228 is a generally elongate hollow barrel having a first end 240 threaded onto and about orifice 224 having a second end 242 through which poppet 230 extends and at which poppet 230 is connected to lever 236. Housing 228 includes interior 244 and aspirator openings 246. Aspirator openings 246 extend between interior 244 of housing 228 and regulator chamber 174 to allow air to pass therebetween. Interior 244 of housing 228 is sealed at one end by seal 245 at the other end by seat 232. Seat 232 is carried by poppet 230. Poppet 230 projects from end 242 of housing 228 and is connected to lever 236. Spring 234 biases poppet 230 and seat 232 towards orifice 224 to seal passage 238 to prevent air from flowing into interior 244 and through aspirator openings 246 into regulator chamber 174.

Lever 236 is coupled to an end of poppet 230 and extends into engagement with moveable wall 180. As shown in phantom by FIG. 13, inhalation by the diver through mouth piece 176 causes a pressure drop within regulator chamber 174 to cause moveable wall 180 to be drawn inward so as to depress lever 236. Depressment of lever 236 moves poppet 230 and seat 232 against spring 234 to open passageway 238. As a result, air flows from air supply passage 76 through passageway 238 into interior 244 and through aspirator openings 246 into regulator chamber 174. During exhalation by the diver, moveable wall 180 returns to its original position in response to the increase in pressure with chamber 174. Consequently, while spring 234 returns lever 236, poppet 230 and seat 232 to their original position so that seat 232 seals passageway 238 until the next inhalation.

Module interface 186 of module 28 is identical to interface 130 of add-on module 26. Similar to module interface 130, module interface 186 nestingly receives interface 54, base module 24. In addition, module interface 186 also includes identically configured tabs 164 having bores 165, detents 166 and fastener receiving channels 168. Because module interface 186 and module interface 130 are substantially identical to on another, modules 26 and 28 can be interchangeable connected to base module 24 to enable the diver to easily upgrade his or her air supply system.

Figure 16:
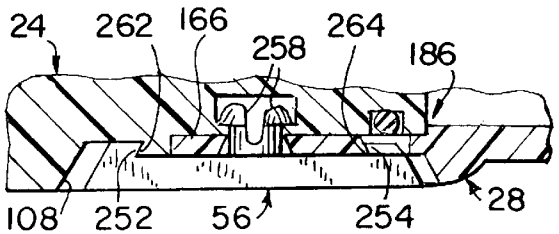
FIG. 16 is a fragmentary sectional view of the base module and the second add-on module taken along lines 16—16 illustrating a fastener maintaining the base module and the second add-on module connected to one another.
Figure 17:
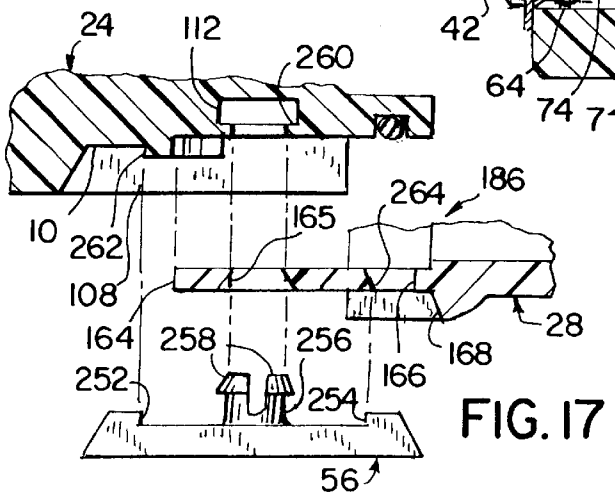
FIG. 17 is a fragmentary perspective view of the base module and the second add-on module of FIG. 13 taken along lines 16—16 illustrating the fastener removed and the base module and the second add-on module separated from one another.

FIGS. 16 and 17 illustrate module interface 54 of base module 24 and module interface 186 of add-on module 28 retained to one another by fastener 56. As best shown by FIG. 16 and 17, fasteners 56 include two oppositely oriented hooks 252, 254 and an outwardly extending lug 256 which widens at its end to form hooks 258. As further shown by FIG. 16 and 17, bore 112 in base module 24 includes a widening cavity 260 sized for receiving hooks 258 of lug 256. Detents 110 of interface 54 and detents 166 of interface 186 include hooks 262 and 264 which correspond to hooks 252 and 254, respectively, of fasteners 56. As a result, as shown by FIG. 16, once base module 24 is releasably connected to add-on module 28, fasteners 56 are positioned within channels 108 and 168 of interfaces 54 and 186, respectively, with hooks 252 and 254 simultaneously engaging hooks 262 and 264 to releasably secure base module 24 and add-on module 28 to one another. Lug 256 further projects through bore 112 of interface 54 and through bore 165 of interface 186 with its hooks 258 captured within cavity 260 to further secure base module 24 and add-on module 28 to one another. Fasteners 56 are preferably formed from a rigid, yet somewhat deformable material such as plastic to enable fasteners 56 to be slightly deformed to disengage hooks 252, 254 and 258 for removing fastener 56 and for separating either module 26 or 28 from base module 24. Because module interface 130 of add-on module 26 is substantially identical to module interface 186 of module 28, module 26 may be releasibly secured to base module 24 and maintained in connection with base module 24 by fasteners 56 in a similar manner.

Although module interfaces 130 and 186 are illustrated as being substantially identical to one another for being interchangeably mounted to module interface 54 of base module 24, module interfaces 130 and 186 may alternatively be have slightly different configurations so long as interfaces 130 and 186 both are releasibly connectable to the same base module 24. As can be appreciated, module interfaces 54, 130 and 186 may have any one of a variety of alternative configurations for enabling the interchangeable mounting of modules 26 and 28 to base module 24. In addition, fasteners 56 may have a variety of alternative configurations as well. For example, fasteners 56 may alternatively be integrally formed as part of either base module 24 or add-on modules 26 or 28. Fasteners 56 may be of a more complex construction or may be of a more simpler construction, such as a screw threadably inserted through bore 165 into bore 112. Although several advantages are associated with the aforementioned example, various other structures are contemplated which would also (1) require a minimum number of high-pressure lines extending from the first stage regulator, (2) eliminate the necessity of shifting between separate mouth pieces of an auxiliary second stage regulator and a power inflator, and (3) enable the diver to individually upgrade his or her air supply system based upon the diver's needs and budget.

Although the present invention has been described with reference to preferred embodiments, workers skilled in the art will recognize that changes may be made in form and detail without departing from the spirit and scope of the invention. The present invention described with reference to the preferred embodiments and set forth in the following claims is manifestly intended to be as broad as possible. For example, unless specifically otherwise noted, the claims reciting a single particular element also encompass a plurality of such particular elements.

What is claimed is:

1. An underwater air supply system for use with an air supply tank and a buoyancy chamber, the system comprising:

a base module and a plurality of interchangeable modules configured to be releasably connectable to the base module, wherein each of the base module and the plurality of interchangeable modules includes at least one of the following: an air supply to buoyancy chamber inflator adapted to selectively deliver air from the air supply tank to the buoyancy chamber, a buoyancy chamber exhaust for selectively exhausting air from the buoyancy chamber, an oral buoyancy chamber inflator for enabling a diver to orally inflate the buoyancy chamber, and an air supply regulator adapted to supply air to a diver from the air supply tank.

2. The system of claim 1, wherein the base module includes:

a first body having a first air supply conduit adapted to be connected to the air supply tank and a first buoyancy chamber conduit adapted to be connected to the buoyancy chamber;

an inflation conduit adapted to interconnect the air supply conduit and the first buoyancy chamber; and a valve selectively moveable to open and close the inflation conduit.

3. The system of claim 2, wherein one of the plurality of interchangeable modules includes:

a second body adapted to be releasably connected to the first body, the second body having a second buoyancy chamber conduit adapted to communicate with the first buoyancy chamber conduit when the first and second bodies are connected;

a plug coupled to the second body and adapted to occlude the first air supply conduit when the first and second bodies are connected;

a mouth piece coupled to the second buoyancy chamber conduit; and a valve selectively moveable to open and close the second buoyancy chamber conduit.

4. The system of claim 3, wherein the plug is integrally formed with the body as part of a single unitary body.

5. The system of claim 2, wherein one of the plurality of interchangeable modules includes:

a second body adapted to be releasably connected to the first body, the second body including a breathing chamber and a second buoyancy chamber conduit adapted to communicate with the first air supply conduit and the first buoyancy chamber conduit, respectively, when the first and second bodies are connected;

a mouth piece connected to the breathing chamber;

a demand valve between the breathing chamber and the first air supply conduit, wherein the demand valve opens in response to a pressure drop within the breathing chamber; and a valve between the breathing chamber and the second buoyancy chamber conduit.

6. The system of claim 5, including a movable wall at least partially defining the breathing chamber and coupled to the demand valve, wherein the movable wall moves in response to a drop in pressure within the breathing chamber and opens the demand valve.

7. The system of claim 5, wherein said one of the plurality of interchangeable modules includes:

an opening within the second body communicating between the breathing chamber and an exterior of the second body; and a uni-directional valve attached to the second body to open and close the opening, wherein the unidirectional valve opens in response to a pressure increase within the breathing chamber.

8. The system of claim 1, wherein one of the base module and the plurality of interchangeable modules is partially nested within the other of the base module and the plurality of interchangeable modules.

9. The system of claim 1, including a fastener for maintaining the base module and one of the plurality of interchangeable modules connected to one another.

10. The system of claim 9, wherein the fastener includes hooks simultaneously engaging the base module and one of the plurality of interchangeable modules.

11. The system of claim 1, wherein at least two of the plurality of the interchangeable modules each include at least one of the following: an air supply to buoyancy chamber inflator adapted to selectively deliver air from the air supply tank to the buoyancy chamber, a buoyancy chamber exhaust for selectively exhausting air from the buoyancy chamber, an oral buoyancy chamber inflator for enabling a diver to orally inflate the buoyancy chamber, and an air supply regulator adapted to supply air to a diver from the air supply tank.

12. An underwater air supply system for use with an air supply tank and a buoyancy chamber, the system comprising:

a base module including a first body having a first air supply conduit adapted to be connected to the air supply tank and a first buoyancy chamber conduit adapted to be connected to the buoyancy chamber;

an inflation conduit interconnecting the first air supply conduit and the first buoyancy chamber conduit; and a valve selectively moveable to open and close the inflation conduit, wherein the first body is configured for being releasably connected to one of a plurality of interchangeable modules including at least one of the following: a buoyancy chamber exhaust for selectively exhausting air from the buoyancy chamber, an oral buoyancy chamber inflator for enabling a diver to orally inflate the buoyancy chamber, and an air supply tank regulator adapted for supplying air to a diver from the air supply tank.

13. The system of claim 12, wherein the first body includes first and second couplings for connecting the air supply conduit and the buoyancy chamber conduit to the air supply tank and the buoyancy chamber, respectively.

14. The system of claim 12, wherein the body includes an air supply conduit port and a buoyancy chamber conduit port adapted to provide communication between the air supply conduit and the buoyancy chamber conduit, respectively, and said one of the plurality of modules.

15. An underwater air supply system for use with an air supply tank and a buoyancy chamber, the system comprising:

a base module including:

a first body having a first air supply conduit adapted to be connected to the air supply tank and a first buoyancy chamber conduit adapted to be connected to the buoyancy chamber;

an inflation conduit interconnecting the first air supply conduit and the first buoyancy chamber conduit; and a first valve selectively moveable to open and close the inflation conduit; and an exhaust/oral inflation module including:

a second body configured for being releasibly connected to the base module and having a second buoyancy chamber conduit adapted to communicate with the first buoyancy chamber conduit when the first and second bodies are connected;

a plug coupled to the second body and adapted to occlude the first air supply conduit;

a mouth piece coupled to the second buoyancy chamber conduit; and a second valve selectively moveable to open and close the second buoyancy chamber conduit.

16. An underwater air supply system for use with an air supply tank and a buoyancy chamber, the system comprising:

a first module including a body having a buoyancy chamber conduit adapted to be connected to the buoyancy chamber;

a mouth piece coupled to the buoyancy chamber conduit; and a valve selectively moveable to open and close the buoyancy chamber conduit, wherein the body is configured for being releasibly connected to a second module including an air supply to buoyancy chamber inflator adapted to selectively deliver air from the air supply tank to the buoyancy chamber, wherein the first module includes a plug adapted to occlude air flow from the air supply tank to the first module.

17. A method for providing an underwater air supply system to use with an air supply tank and a buoyancy chamber, the method comprising:

providing a base module and a plurality of interchangeable modules configured to be releasably connectable to the base module, wherein each of the base module and the plurality of interchangeable modules includes at least one of the following: an air supply to buoyancy chamber inflator adapted to selectively deliver air from the air supply tank to the buoyancy chamber, a buoyancy chamber exhaust adapted for selectively exhausting air from the buoyancy chamber, an oral buoyancy chamber inflator for enabling a diver to orally inflate the buoyancy chamber, and an air supply regulator adapted to supply air to a diver from the air supply tank;

connecting a first one of the plurality of interchangeable modules to the base module; and interchanging the first one of the plurality of interchangeable modules with a second one of the plurality of interchangeable modules, wherein the first one of the plurality of interchangeable modules and the second one of the plurality of interchangeable modules each include at least one identical component selected from the following:

an air supply to buoyancy chamber inflator adapted to selectively deliver air from the air supply tank to the buoyancy chamber, a buoyancy chamber exhaust for selectively exhausting air from the buoyancy chamber, an oral buoyancy chamber inflator for enabling a diver to orally inflate the buoyancy chamber, and an air supply regulator adapted to supply air to a diver from the air supply tank.

18. The method of claim 17 wherein the base module includes a first body having a first air supply conduit adapted to be connected to the air supply tank and a first buoyancy chamber conduit adapted to be connected to the buoyancy chamber;

an inflation conduit interconnecting the first air supply conduit and the first buoyancy chamber conduit;

a first valve selectively moveable to open and close the inflation conduit; and wherein the first one of the plurality of interchangeable modules includes:

a second body configured to be releasably connected to the base module and having a second buoyancy chamber conduit adapted to communicate with the first buoyancy chamber conduit when the first and second bodies are connected;

a plug coupled to the second body and adapted to occlude the first air supply conduit;

a mouth piece coupled to the second buoyancy chamber conduit; and a second valve selectively movable to open and close the second buoyancy chamber conduit.

* * * * *